US008087645B2

(12) United States Patent
Hepple

(10) Patent No.: US 8,087,645 B2
(45) Date of Patent: Jan. 3, 2012

(54) HUMIDIFIER

(76) Inventor: David Hepple, Columbia, MD (US)

( * ) Notice: Subject to any disclaimer, the term of this patent is extended or adjusted under 35 U.S.C. 154(b) by 493 days.

(21) Appl. No.: 12/317,843

(22) Filed: Mar. 17, 2009

(65) Prior Publication Data

US 2009/0174089 A1 Jul. 9, 2009

Related U.S. Application Data

(63) Continuation-in-part of application No. 11/408,006, filed on Apr. 20, 2006, now abandoned.

(60) Provisional application No. 60/702,871, filed on Jul. 27, 2005.

(51) Int. Cl.
*B01F 3/04* (2006.01)

(52) U.S. Cl. ..... 261/99; 261/104; 84/453

(58) Field of Classification Search ..... 261/94, 261/95, 97, 99, 104, 107, DIG. 34, DIG. 65; 84/453

See application file for complete search history.

(56) References Cited

U.S. PATENT DOCUMENTS

| | | | | |
|---|---|---|---|---|
| 3,407,700 | A * | 10/1968 | Hollander | 84/453 |
| 3,719,033 | A * | 3/1973 | Den Boer | 96/153 |
| 3,721,152 | A * | 3/1973 | Von Meyer | 84/453 |
| 4,572,051 | A * | 2/1986 | Laskin | 84/453 |
| 4,649,793 | A * | 3/1987 | Blackshear et al. | 84/453 |
| 5,289,751 | A * | 3/1994 | Light | 84/275 |
| 5,829,452 | A * | 11/1998 | Oster | 131/250 |
| 5,936,178 | A * | 8/1999 | Saari | 84/453 |
| 6,029,804 | A * | 2/2000 | Flynn | 206/14 |
| 6,209,717 | B1 * | 4/2001 | Flynn | 206/204 |
| 6,375,000 | B1 * | 4/2002 | Weder et al. | 206/204 |
| 6,681,661 | B2 * | 1/2004 | Lalonde | 84/267 |
| 6,959,810 | B2 * | 11/2005 | Neilson | 206/314 |

* cited by examiner

*Primary Examiner* — Charles Bushey
(74) *Attorney, Agent, or Firm* — William S. Ramsey

(57) ABSTRACT

This invention is a humidifier used to increase and maintain the humidity of a musical instrument, such as a guitar. The humidifier is a container made of a water vapor permeable material that contains a water absorbent material such as acrylate polymer. The container is held within the body of the instrument by being mounted onto the strings of the instrument. The container is filled with water by an opening that is sealed with a cap. The water absorbent material can hold water without dripping, but will allow the water to evaporate.

3 Claims, 3 Drawing Sheets

HUMIDIFIER

CROSS-REFERENCE TO RELATED APPLICATIONS

This is a continuation-in-part application based on Utility Patent Application Ser. No. 11/408,006, filed Apr. 20, 2006, now abandoned which application claims the benefit of Provisional Patent Application Ser. No. 60/702,871, filed Jul. 27, 2005 by the present inventor.

FEDERALLY SPONSORED RESEARCH

No

SEQUENCE LISTING OR PROGRAM

No

FIELD OF INVENTION

This invention relates to musical instruments. More specifically it relates to humidifying musical instruments. Even more specifically it relates to humidifying string instruments.

BACKGROUND OF THE INVENTION

Most modern stringed instruments are made of wood. One of the limitations of wood as a material is that it is affected by changes in atmospheric humidity. Increased humidity can cause the wood in the instrument to expand. Decreases in humidity can cause the wood of the instrument to contract. Research has shown that relative humidity less than 40% can remove water from the wood in the instrument. These changes will affect the tone of the instrument. These changes can also cause the material of the instrument to fail, especially if the wood in the instrument contracts risking cracking or splitting joints between pieces of wood. In the event that the wood cracks or joints split, the instrument is rendered inoperable. Any musician is aware of the danger of humidity change to their instrument. A number of patents attempt to control the humidity in a musical instrument, but do not have the advantages of the present invention.

U.S. Pat. No. 3,407,700 by Hollander uses a sponge contained within an impermeable case that has holes in it. Water is soaked into the sponge and then the water is allowed to evaporate out the holes of the case into the body of the instrument. The present invention uses a water absorbent material, rather than a sponge. The use of a water absorbent material allows for a greater quantity of water to be used and avoids dripping. This allows for greater control over the humidity within the instrument. Furthermore, the sponge dries out quickly and, in practice, requires daily refills. The amount of water than the sponge can absorb is limited because after a certain amount, liquid water oozes out of the sponge. This results in the liquid water being released into the inside of the instrument, risking warping the wood of the instrument. Finally, the sponge releases water unevenly so that more water is released at first and then less and less water is released over time.

U.S. Pat. No. 5,289,751 by Light uses a water absorbent material contained with a relatively stiff tube made of a vapor permeable material. The problem with a rigid tube is that it makes it difficult to determine if the tube is empty or full. The present invention uses a flexible tube that deflates as it is emptied of water, allowing for easy determination of the quantity of water in the present invention.

U.S. Pat. No. 5,936,178 by Saari is a humidifier for boxes that contain cigars, violins or computer hard drives. U.S. Pat. No. 6,244,432 by Saari is a similar system for use with boxes that contain guns. Saari uses a saturated solution of some solute such as salt or sugar. This solution can be thickened to a material with an additive. The solution is then placed within a pouch of permeable material that releases water vapor to humidify the instrument. The present invention does not use a salt or sugar solution, but uses a material as the water absorbent substance. Furthermore, the Saari patent does not have a way to refill the device. Thus, in dry environments, the Saari patent device will dry out quickly and be rendered useless.

U.S. Pat. No. 6,375,000 by Weder also uses a salt solution. In this case the solution is made of water and a cross-linked polyacrylic acid sodium salt. The sodium salt is in powder or film form and is contained within a porous pouch that have holes too small for liquid water to escape, but large enough for water vapor to escape. The present invention does not use cross-linked polyacrylic acid sodium salt, but uses a water absorbent material such as acrylate polymer. Like the Saari patent, the Weder patent lack a way to refill the device. This will limit the effectiveness of the Weder device in a dry climate, as it will dry out quickly and become useless.

U.S. Pat. No. 5,829,452 by Oster uses a similar gel as the preferred embodiment of the present invention, but is specifically aimed at use with cigar humidors. While Oster does refer to systems that are used to humidify musical instruments in the Background of the Invention section of the Oster patent, Oster does not claim the use of '452 with musical instruments.

SUMMARY OF INVENTION

This invention is a device that increases and maintains the humidity within a musical instrument. While the instrument is envisioned for use with acoustic guitars, the invention could be used with any hollow bodied stringed instrument. This would include, but not be limited to, violins, cellos, violas, double bass, mandolins, and dulcimers. With further modifications, obvious to anyone skilled in the art, the invention could also be used in any other musical instrument.

The invention is a container that is made of a material that is water vapor permeable but not liquid permeable. This material is permeable only to water vapor, not all gases. Furthermore, the material only allows water vapor to evaporate out of the container, but not into the container. As the water vapor evaporates out of the container, the contain shrinks or collapses. Thus a user can tell if the container is empty because the container has changed shape.

This container is permanently sealed at the bottom end. The top end is also sealed, but can be opened for refilling by twisting off a screw cap. The container is attached to a collar that fits over the neck of the tube below the twist cap and acts as a mounting bar. In the preferred embodiment, the container is held in place by inserting the container through the middle two guitar strings into the guitar sound cavity to the point where the two strings fit snugly against the neck of the container below the collar. The container is made of a fabric material that is permeable to water vapor, but not liquid water. Thus the container can contain liquid water, but not allow the water to spill into the body of the instrument. In the preferred embodiment, the fabric material is specifically designed to allow a measured amount of water vapor to evaporate over a 24-hour period that will allow the guitar sound cavity to achieve and maintain relative humidity between 40-60%.

In one embodiment of the invention, the container contains a water absorbent material. The absorbent material within the container is some material that is capable of absorbing and holding a relatively large quantity of water. In the preferred embodiment, the water absorbent material is a material and will prevent water from dripping once it is absorbed. In the preferred embodiment the absorbent material would be an acrylate polymer. But any material that can absorb and retain water could be used. Other versions of the invention, the container does not use the material and empty until the container is filled with water.

BRIEF DESCRIPTION OF THE DRAWINGS

The accompanying drawings, which are incorporated in and form part of the specification, illustrate the embodiments of the present invention and, together with the description, serve to explain the principles of the invention.

DETAILED DESCRIPTION OF THE DRAWINGS

Figure 1:
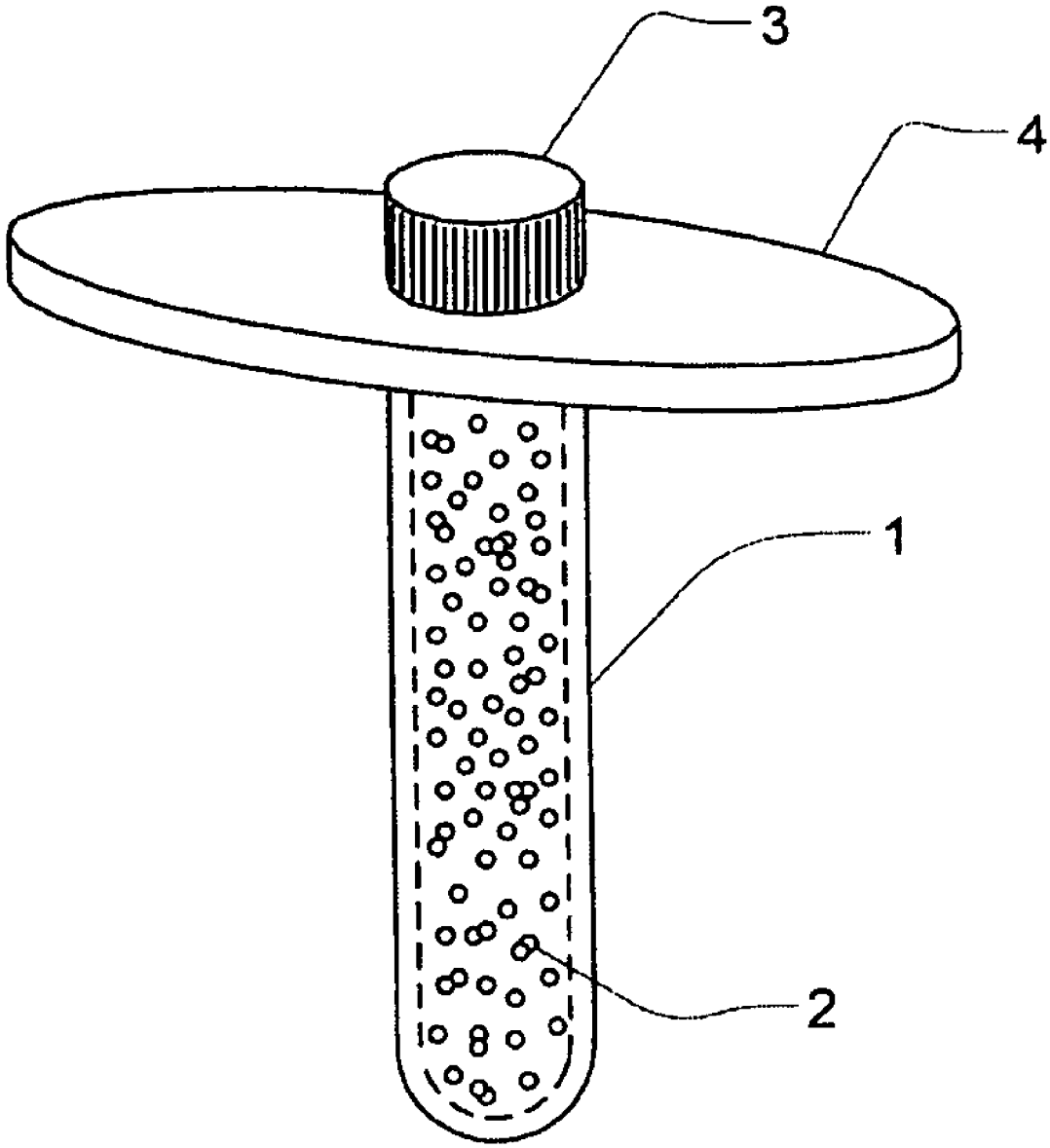
FIG. 1 is a picture of the invention as viewed from the side.

FIG. 1 illustrates a side view of the invention. FIG. 1 shows the container 1 with the absorbent material 2 inside it. At one end of the container 1 are a mount 4 and a cap 3.

Figure 2:
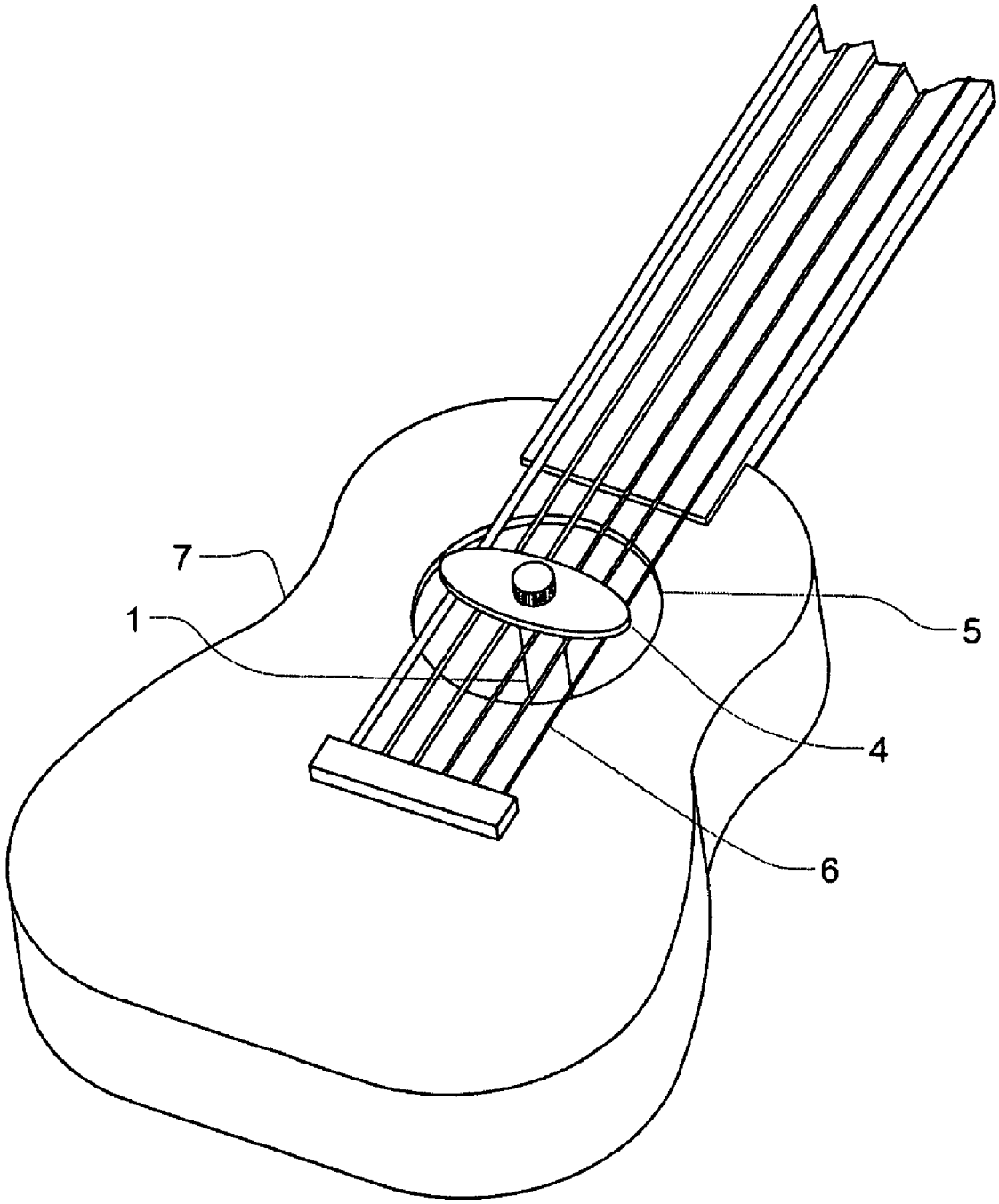
FIG. 2 is a picture of the invention while inserted into a guitar.

FIG. 2 illustrates the invention in use. FIG. 2 shows the container 1 placed between the strings 6 of the instrument 7 so that container 1 is within hole 5. Container 1 is supported by mount 4 so that cap 3 is outside the hole 5.

Figure 3:
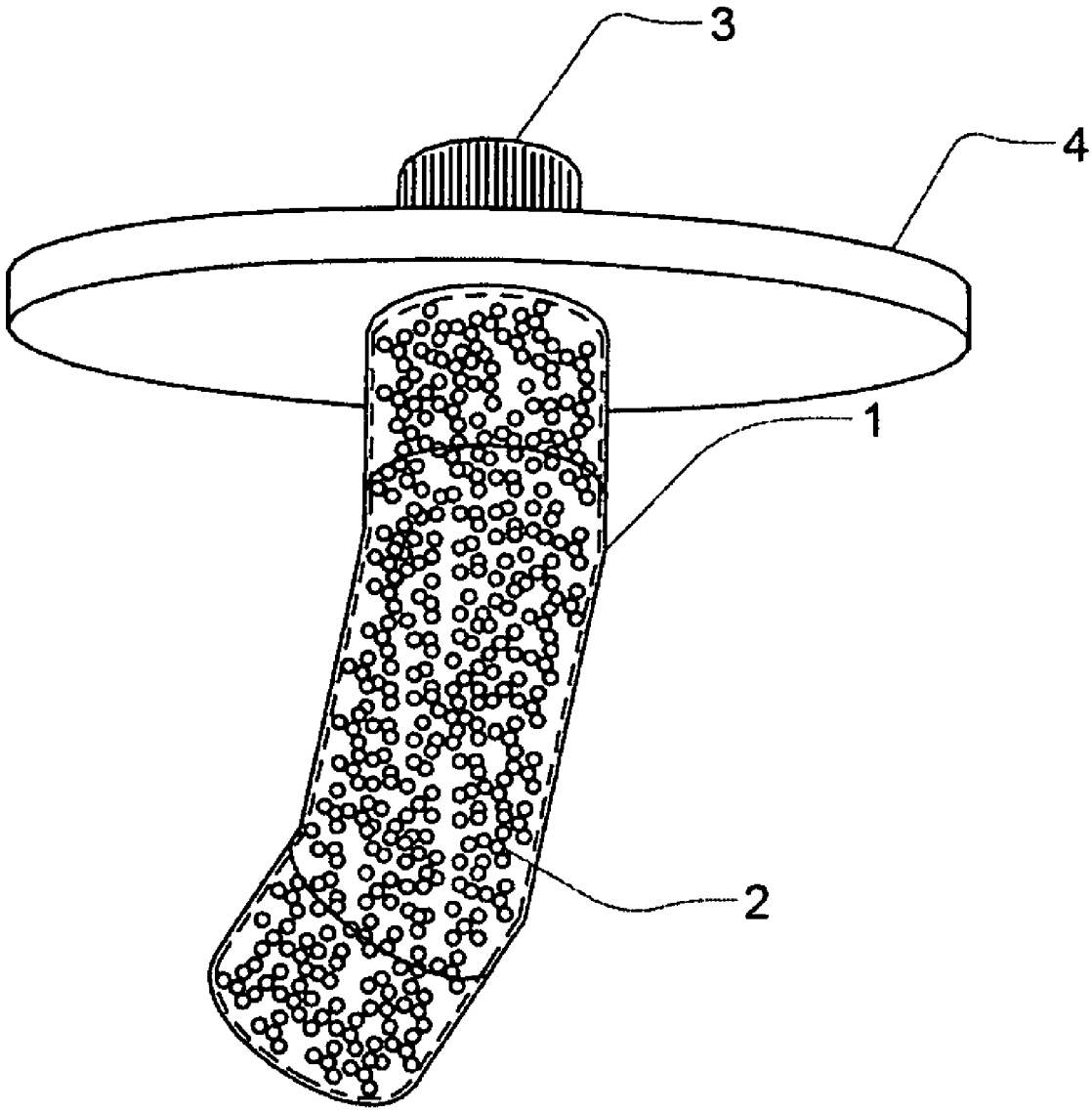
FIG. 3 is a picture of the invention as viewed from the side when the invention is empty of water.

FIG. 3 illustrates a side view of the invention with the container 1 empty of water. FIG. 3 shows the container 1 with the absorbent material 2 inside it. At one end of the container 1 are a mount 4 and a cap 3. The container 1 is empty of water and has shrunk.

The container 1 is made of a water vapor permeable material that is not permeable to liquid water. In the preferred embodiment, the material of container 1 is specifically designed to allow a measured amount of water vapor to evaporate over a 24-hour period that will allow the guitar sound cavity to achieve and maintain a relative humidity between 40-60%. Other embodiments could allow the water to evaporate at a faster rate so that a single version of the invention would allow all the water contained in container 1 to evaporate in less than 24 hours. Other embodiments could allow the water to evaporate at a slower rate so that a single version of the invention would allow all the water contained in container 1 to evaporate in more than 24 hours. In still other embodiments, the material of container 1 would allow water to evaporate so that a relative humidity of less than 40% in maintained in the instrument 7. In still other embodiments, the material of container 1 would allow water to evaporate so that a relative humidity of more than 60% is maintained within the instrument 7.

The container 1 could be of any size. In the preferred embodiment, container 1 is of a size that is specifically designed to allow a measured amount of water vapor to evaporate over a 24 hour period, which will allow the guitar sound cavity to achieve and maintain relative between 40-60%. Other embodiments may use a smaller container 1 that would allow all the water it contains to evaporate in less than 24 hours. Still other embodiments could use a larger container 1 that would allow all the water it contains to evaporate in more than 24 hours.

In some embodiments, container 1 is made of a material that has a single layer. The container 1 can also be made of a material that has more than one layer. In this embodiment, the container 1 could consist of an inner layer that is water vapor permeable, but not liquid water permeable. The material is permeable to only water vapor, but not to other gases. The outer layer is made of a material that is both water and water vapor permeable. Alternatively, the outer layer could be just vapor permeable, but not water permeable. The outer layer could be made of a material more durable than the inner layer, or in a color or level of translucent that is different than the inner layer.

Embodiments of the invention have a container made of two layered laminated material having an inner layer and an outer layer, the outer layer comprised of polyester microdenier fabric weighing 5.45 ounce per year, the material allows the passage of water vapor through the material but blocks and acts as a barrier to the passage of liquid water through the material.

In embodiments the inner layer is comprised of an engineered thermoplastic polyester elastomer which allows water vapor to pass through the layer but is a barrier for liquid water. In embodiments the inner layer is comprised of HYTREL® polyester elastomer. HYTREL® is a trademark for polyester elastomers owned by E.I. Du Pont De Nemours & Company Corporation, Wilmington, Del.

In embodiments the inner layer is comprised of a fabric with polytetrafluoroethylene laminate which allows water vapor to pass through the layer but is a barrier for liquid water. In embodiments the inner layer is comprised of GORE-TEX® fabric with polytetrafluoroethylene laminate. GORE-TEX® is a trademark for fabric with polytetrafluoroethylene laminate owned by W.L. Gore & Associates, Inc., Newark, Del.

The preferred embodiment of the invention envisions a container 1 made of a supple fabric material that allows the invention to change shape as the quantity of water in the invention changes. When the container is filled with water it is relatively firmer than when the container 1 is empty. When the container 1 is empty of water the container 1 is more flexible. When the container 1 is relatively firm, the invention remains relatively perpendicular to the strings 6 of the instrument 7, even when the hole 5 of instrument 7 is turned relative to the pull of gravity. The desired overall effect is that the container 1 will point into the hole 5 of the instrument 7 and be pointed at the bottom of the instrument 7, even when the instrument 7 is turned on its side. Note that the bottom of instrument 7 is the side opposite the side with the hole 5. As an example, but not as a limitation, the invention when placed in a guitar will remain perpendicular to the strings 6 of the guitar even when the guitar is placed on its side to be played.

The flexibility of the material of container 1 also will allow the user to observe the amount of water in container 1 without opening container 1. As the water in container 1 evaporates, the container will collapse, indicating that the container 1 contains a smaller amount of water than before. Because the material of container 1 is both permeable to water vapor and not permeable to other gases, the container 1 will appear to shrink and collapse as water evaporates out of the container 1.

The absorbent material 2 is any material that can absorb water and release water. The preferred embodiment envisions the use of an acrylate polymer as the absorbent material 2. In other embodiments, other materials could be used, including solutions. The important qualities of absorbent material 2 is that absorbent material 2 can hold a relatively large quantity of water and release that water as water vapor through evaporation. In the preferred embodiment, absorbent material 2 can absorb water in such a way that it does not drip, ooze or release liquid water. Still other versions could not include the absorbent material 2.

Water is added to the invention by being poured into the opening that is sealed by cap 3.

The invention must be mounted so that it is placed within the body of the instrument 7. Thus the invention must be inserted into a hole 5 in the body of the instrument 7. The stabilizing bar for the invention is mount 4. Mount 4 allows the invention to hang from the strings 6 of instrument 7 so that the invention is hanging from the strings 6 and placed within the body of the instrument 7. Alternatively, the invention could be mounted in a hole 5 within the body of the instrument 7 by gripping the instrument 7 by mount 4. Mount 4 can have a layer of padding to reduce the chance of scuffs on the surface of the instrument 7. Alternatively, mount 4 can have an adhesive surface to insure that it grips the instrument 7 and does not dismount. In the preferred embodiment, mount 4 is made of a firm, gripping material such as rubber or latex.

Mount 4 also could be shaped as a ring or a bar. The preferred embodiment envisions the use of a bar to mount the invention to the musical instrument 7. In the preferred embodiment, the invention is inserted between two of the middle strings 6 of the instrument 7 so that the container 1 is within the body of the instrument 7. The mount 4, in the form of a bar is oriented so that its length is perpendicular to the strings 6 of the instrument 7. The purpose of this arrangement is to insure that the container 1 remains securely within the body of the instrument 7, even when the instrument 7 is moved.

Although this invention has been illustrated by reference to specific embodiments, it will be apparent to those skilled in the art that various changes and modification may be made which clearly fall within the scope of the invention. The invention is intended to be protected broadly within the spirit and scope of the appended claims.

I claim:

1. A humidifier for musical instruments comprising:

a musical instrument with strings and a hollow body;

a flexible container made of water vapor permeable, but not liquid permeable, material that allows water vapor to evaporate out of the container, the container has an opening on one end;

a cap on the opening of the container;

a mounting bar attached to the container at the end with the opening and the cap;

so that when water is poured into the container through the opening, then the opening is closed by sealing the cap and the humidifier is mounted onto the strings of the instrument using the mounting bar with the container within the body of the instrument and then the container will release the water as water vapor, resulting in the container changing shape and raising the humidity of the body of the instrument.

2. The humidifier of claim 1 where the container contains an acrylate polymer that can absorb and release water.

3. The humidifier of claim 2 where the container is large enough to contain enough water so that the acrylate polymer releases water vapor so the relative humidity of 40-60% is maintained for 24 hours.

* * * * *